US007552552B1

(12) United States Patent
Garman et al.

(10) Patent No.: US 7,552,552 B1
(45) Date of Patent: Jun. 30, 2009

(54) WATER FILL ASSEMBLY FOR A STEAM IRON

(75) Inventors: Michael S. Garman, Midlothian, VA (US); Dorian O. Archer, Richmond, VA (US)

(73) Assignee: Hamilton Beach Brands, Inc., Glen Allen, VA (US)

( * ) Notice: Subject to any disclaimer, the term of this patent is extended or adjusted under 35 U.S.C. 154(b) by 0 days.

(21) Appl. No.: 12/077,052

(22) Filed: Mar. 14, 2008

(51) Int. Cl.
*D06F 75/12* (2006.01)
*D06F 75/00* (2006.01)

(52) U.S. Cl. ..... 38/77.8; 38/77.82

(58) Field of Classification Search ..... 38/77.1–77.83, 38/88; D7/399; 99/306
See application file for complete search history.

(56) References Cited

U.S. PATENT DOCUMENTS 2,662,316 A * 12/1953 Johnson ..... 38/77.81
2,663,100 A * 12/1953 Bricker ..... 38/77.81
2,680,312 A * 6/1954 Parr ..... 38/77.83
3,996,846 A * 12/1976 Hupf ..... 99/307
4,045,894 A 9/1977 Toft et al.
4,086,714 A * 5/1978 Coggiola ..... 38/77.82
4,213,258 A 7/1980 Reinstadler et al.
4,398,364 A * 8/1983 Augustine et al. ..... 38/77.5
D294,991 S 3/1988 Johnson et al.
4,748,755 A * 6/1988 Bain et al. ..... 38/88
5,414,945 A 5/1995 Freeman et al.
5,787,615 A * 8/1998 Hensel et al. ..... 38/77.5
5,931,329 A * 8/1999 Wu ..... 220/212
6,243,976 B1 * 6/2001 Beverly et al. ..... 38/77.5
D457,996 S 5/2002 Figur et al.
D531,773 S 11/2006 Leung
D544,165 S 6/2007 Massip et al.
D546,518 S 7/2007 Massip et al.

* cited by examiner

*Primary Examiner*—Ismael Izaguirre
(74) *Attorney, Agent, or Firm*—Roger S. Dybvig

(57) ABSTRACT

A water fill device for a steam iron is provided with a shield in front of the outlet port thereof designed to enhance the appearance of the iron and to provide consumers with increased confidence in the avoidance of water spillage or leakage through the water fill device.

7 Claims, 3 Drawing Sheets

WATER FILL ASSEMBLY FOR A STEAM IRON

FIELD OF THE INVENTION

This invention relates to a water fill assembly for a household steam iron.

INCORPORATION BY REFERENCE

The entirety of U.S. Pat. No. 6,243,976, issued to Beverly et al. on Jun. 12, 2001, is hereby incorporated by reference herein.

BACKGROUND OF THE INVENTION

Household steam irons include a water reservoir for containing water to be converted to steam when needed during an ironing process. Water is typically introduced into a water reservoir through a water fill device located at the front of the iron and opening to the water reservoir, the water fill device having a mouth into which water can be poured from a pitcher or a water tap. Such method of filling a water reservoir of an iron is illustrated in the above mentioned Beverly et al. U.S. Pat. No. 6,243,976.

In many irons the water fill device includes a sliding or pivoting closure normally covering the water fill mouth and which is moved to uncover the mouth to permit water to be poured through the water fill device. However, the closure member and mounting parts are typically small and therefore subject to damage and somewhat difficult to manufacture. There are also irons that have water fill devices which have open mouths and no means to close the water fill devices. For several years many and perhaps most steam irons have been so constructed that leakage or spillage of water from the reservoir forward through the water fill device is avoided. These are satisfactory under most circumstances and have the advantage of being inexpensive and of rugged construction because they have no moving parts. However, some consumers may perceive that water, which might be heated, may spill or leak out of an iron through the water inlet opening of an uncovered water fill device and cause damage or injury. Also, some people believe that a water fill device which does not have a cover hiding its outlet port is aesthetically undesirable.

SUMMARY OF THE INVENTION

This invention provides a water fill device provided with a shield designed to enhance the appearance of the iron and to provide consumers with increased confidence in the avoidance of water spillage or leakage through the water fill device.

Other objects, advantages and features of this invention will become apparent from the following description and the drawings.

BRIEF DESCRIPTION OF THE DRAWINGS

FIG. 2 also shows surrounding structure by broken lines.

DETAILED DESCRIPTION

Figure 1:
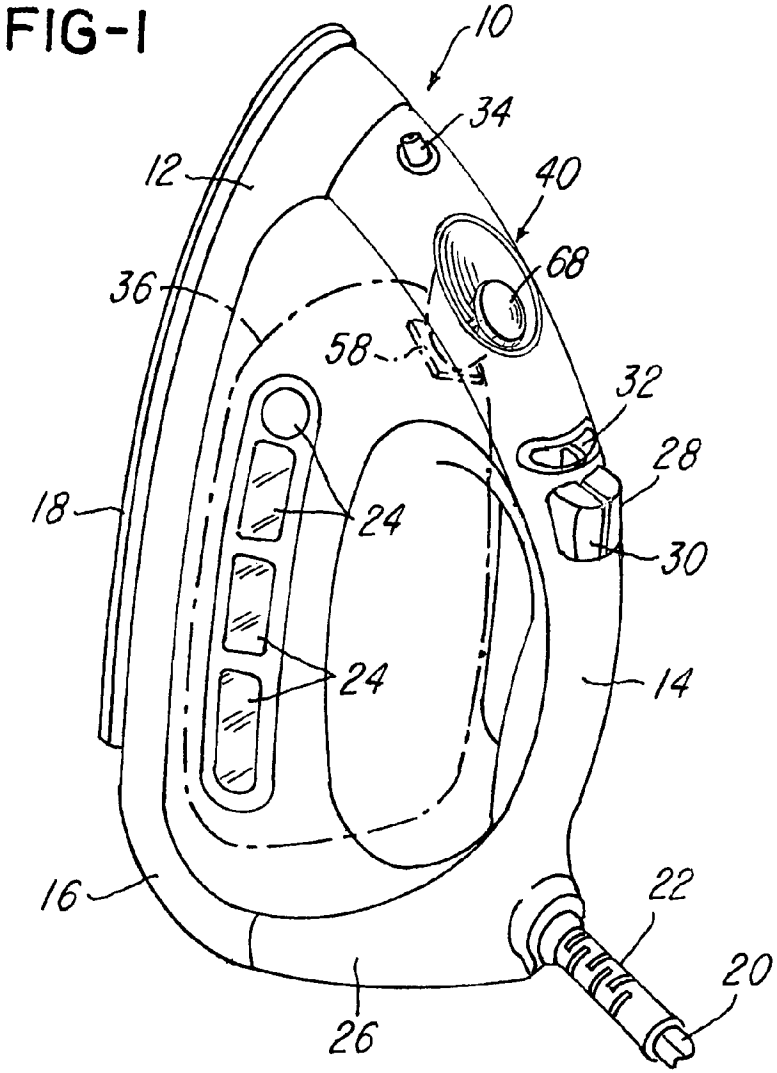
FIG. 1 is an isometric view of a steam iron shown resting in a generally vertical orientation provided with a water fill device of this invention. A water reservoir supported by the steam iron housing is diagrammatically indicated by broken lines in FIG. 1.

FIG. 1 illustrates a representative steam iron 10 with which this invention may be used. The representative steam iron 10 comprises a housing 12 includes a top cover 14 and a bottom cover 16 supported by a soleplate 18 provided with steam vents (not shown). A power cord 20 used for providing electric current to a soleplate heater (not shown) is protected by a cord guard 22. Control of the operation of the soleplate heater is obtained by electric and/or electronic circuitry including plural lighted switch operating members 24. The rear 26 of the housing 12 is suitably formed to support the iron 10 in the upright orientation shown in FIG. 1. Steam and spray pump operators 28 and 30, a steam control knob 32, and a spray nozzle 34 project outwardly through the housing top cover 14.

Figure 3:
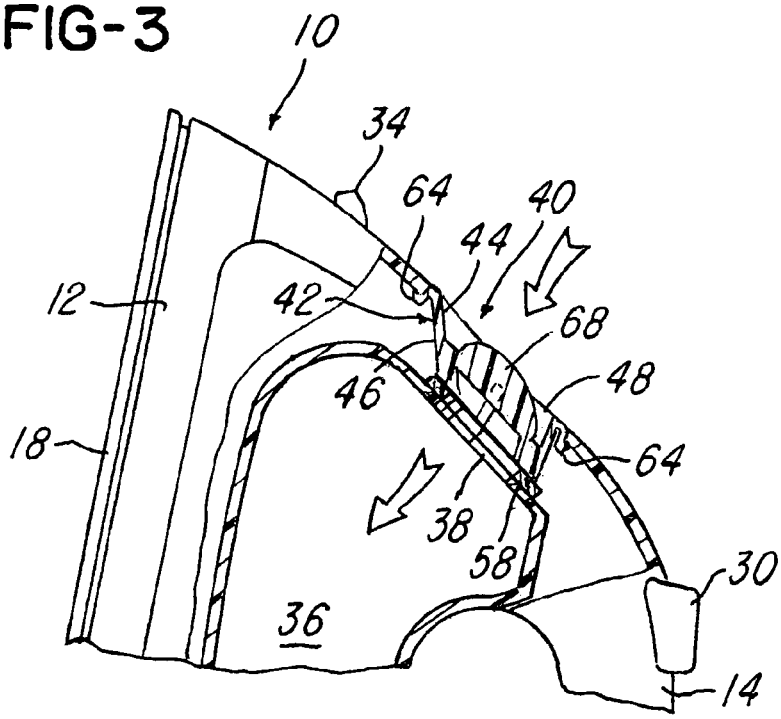
FIG. 3 is a fragmentary side elevational view of the steam iron of FIG. 1 with parts broken away and parts in cross section. Arrows in FIG. 3 generally illustrate the path of water when poured into the water reservoir.
Figure 4:
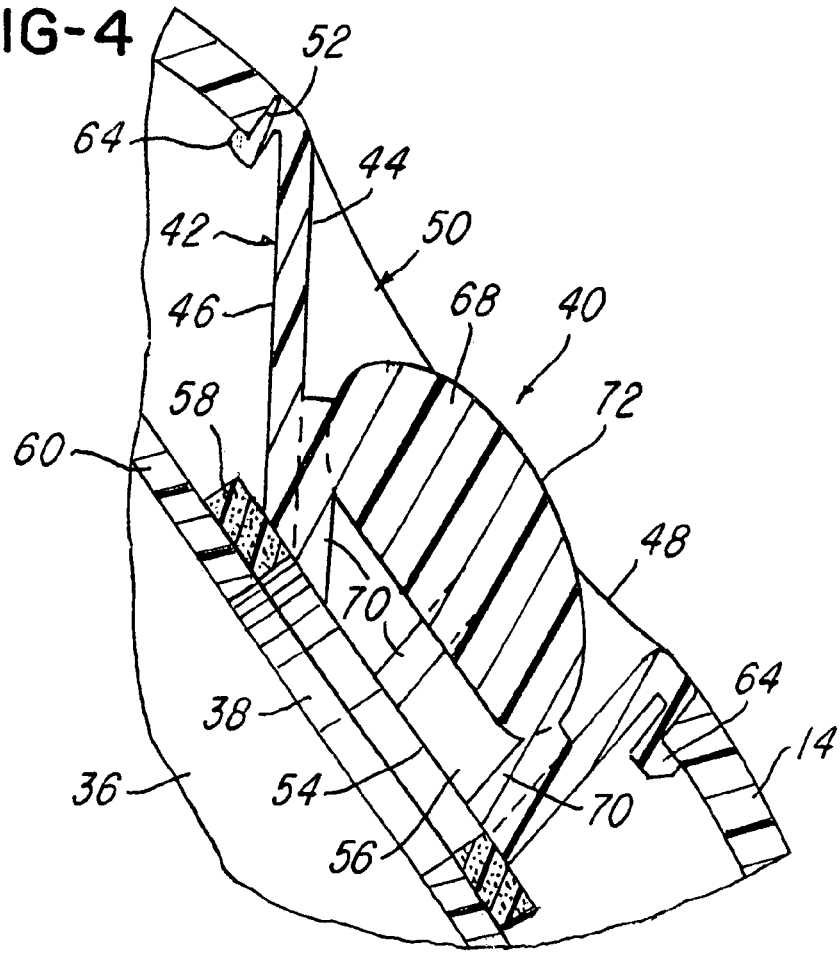
FIG. 4 is an enlarged, fragmentary cross-sectional view of the water fill device of this invention and adjacent parts of the steam iron.
Figure 5:
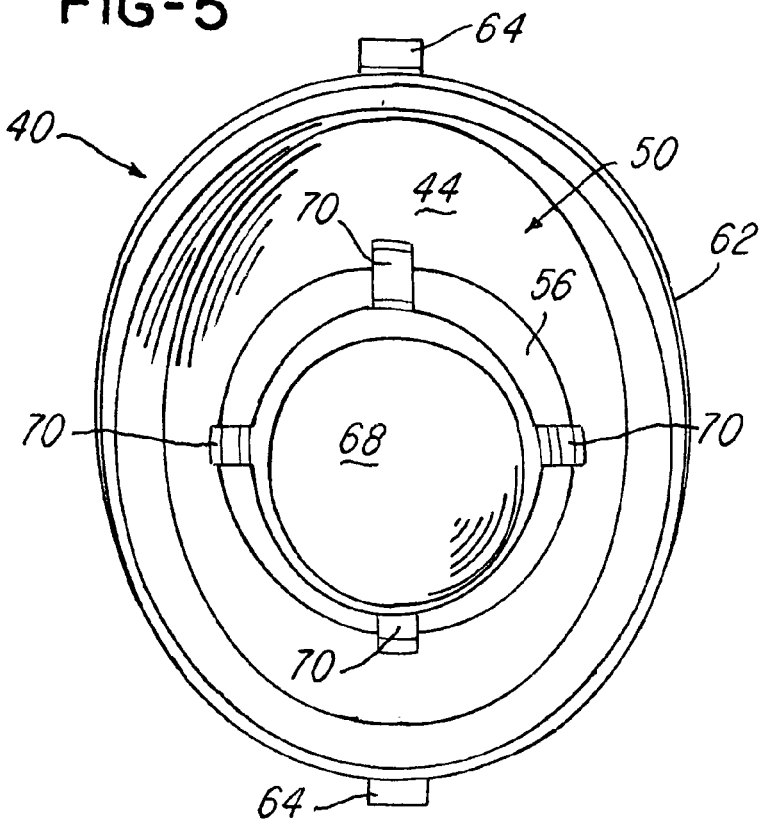
FIG. 5 is a front elevational view of the water fill device of the preceding figures.

A water reservoir 36 shown in FIGS. 3 and 4 and indicated in phantom in FIG. 1 is supported by the soleplate 18 and, as seen in FIGS. 3 and 4, has a water inlet port 38.

Figure 2:
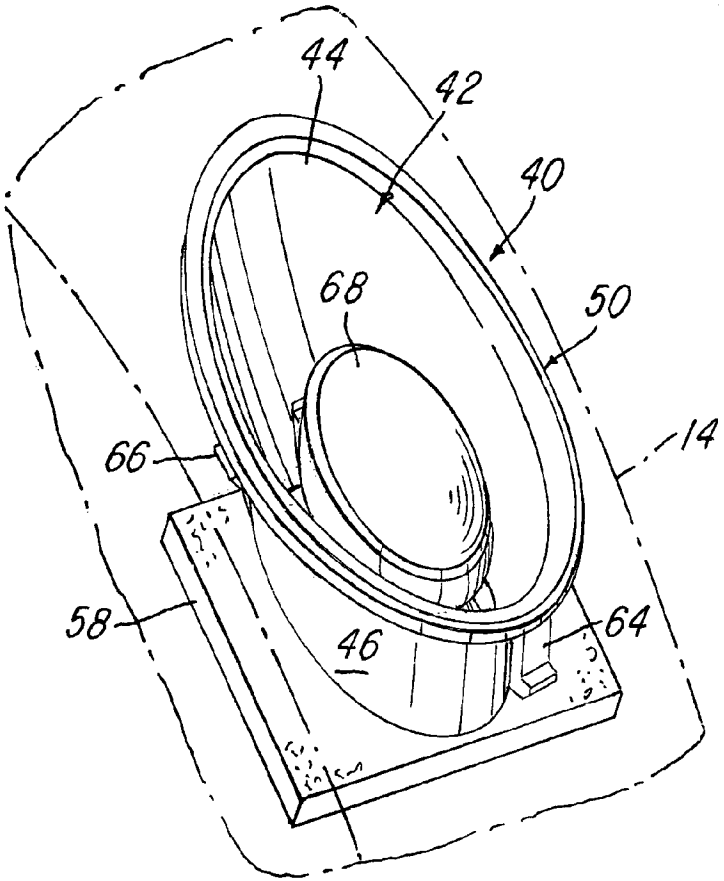
FIG. 2 is an enlarged isometric view of the water fill device of FIG. 1.
Figure 6:
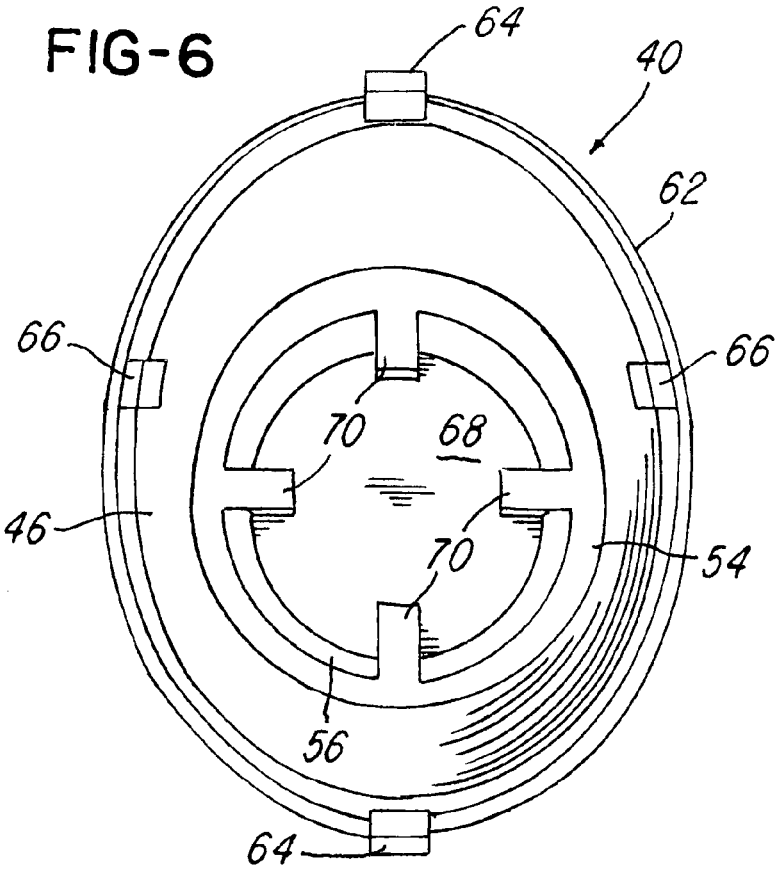
FIG. 6 is a rear elevational view of the water fill device of the preceding figures.

The steam iron 10 additionally includes a water fill device, generally designated 40, comprising, in accordance with this invention, a water funnel 42 having a inner surface 44 and an outer surface 46 extending along its entire length. In addition, the water funnel 42 has a front, water inlet end 48 that forms a water inlet port 50 opening to the front of the iron housing 12 through an opening 52 in the top cover 14 and a rear, water outlet end 54 that forms a water outlet port 56 opening to the water inlet port 38 of the reservoir housing 36. A gasket 58 made of a foam plastic or other suitable material separates the rear end 46 of the water funnel 42 from the front wall, designated 60, of the water reservoir 36. As conventional, an adhesive material (not shown) adheres the gasket 58 to the outside surfaces of reservoir front wall 60 surrounding the water inlet port 38 of the reservoir 36. The water inlet port 50 of the funnel 42 is formed as a large mouth having an outer rim 62 frictionally mounted in the opening 52 in the top cover 14 and held against removal from the housing 12 by a pair of snaps 64 (FIGS. 2-6) extending from the outer rim 62 and by a pair of protrusions 66 (FIGS. 2 and 6) formed on the outer surface 46 of the water funnel 42.

In accordance with this invention, the water fill device 40 further comprises a shield 68 supported in front of the outlet port 56 by a web construction fixed to the inside surface 44 of the water funnel 42. The particular web construction shown in the drawings comprises four mutually equally spaced support posts 70 extending between the outlet port 56 of the water funnel 42 along the inner surface 44 thereof and joined to the shield 68 along its outer edges. The shield 68 is spaced sufficiently from the nearest adjacent surface portions of the inner funnel surface 44 that water poured into the water fill device 40 through its inlet port 50 will readily flow around the shield 68 and the supports posts 70 into the water reservoir 36 without pooling of the water within the water fill device 40. In addition the funnel 42 is sufficiently large that the user of the iron can pour water onto the inside funnel surface 44 without pouring water onto the shield 68.

The shield 68 has an arcuate, curved outwardly-facing surface 72 shaped to assist in avoiding water splashing out of the water fill device 40 when water is being poured into it. The shape of the shield 68 is such that the water hitting the curved surface 72 of the shield 68 is directed toward the inside funnel surface 44 and captured in the funnel 42. Once the water is captured in the funnel 42 it is directed toward the water reservoir 36. Shield 68 could also have a curved lower surface which mirrors the shape of the upper surface 72 to assist in removing water from the reservoir 36. Experimentation may be required to determine optimal shape and size of the mouth of a water fill device 40, to determine and the size, shape and location of a shield 68, and to determine the open area which must be provided between the shield 68 and the water outlet port 56 of the water fill device. In general, the experimentation should be done with a view to providing for adequate water flow rates through the water fill device 40 without having water splash away from the water fill device 40.

Water fill device 40 is preferably molded in one piece from a suitable plastic material of which many are available and well known in the art.

While the invention has been particularly shown and described with reference to a preferred embodiment thereof, it will be understood by those skilled in the art that various alterations in form and detail may be made therein without departing from the spirit and scope of the invention.

We claim:

1. A steam iron comprising a housing, a soleplate, a steam chamber, a water reservoir supported by said housing for holding water to be converted to steam in said steam chamber when the iron is in use, said water reservoir having a water inlet port, and a water fill device mounted on said housing and usable for adding water to said reservoir through said water inlet port, said water fill device comprising:

a hollow, tubular water funnel having a front end located at the front end of said iron housing and a rear end opening to said water inlet port; said front end of said funnel forming an open mouth for receiving water poured into said funnel and said funnel having an inside surface adapted to funnel water from said mouth into said reservoir through an outlet port at said rear end thereof; and a shield within said water funnel in front of said outlet port, said shield having an outer margin spaced from said inside surface of said funnel, and a curved, outwardly-facing surface shaped to assist in avoiding water splashing out of the water fill device when water is being poured into it, and a shield-supporting web connected to said inside surface of said funnel and to said shield.

2. The steam iron of claim 1 wherein said water fill device is molded in one piece from a plastic material.

3. The steam iron of claim 1 wherein said shield-supporting web comprises plural support posts extending longitudinally of said water funnel and connected to said shield.

4. The steam iron of claim 3 wherein said water fill device is molded in one piece from a plastic material.

5. A steam iron comprising a housing, a soleplate, a steam chamber, a water reservoir supported by said housing for holding water to be converted to steam in said steam chamber when the iron is in use, said water reservoir having a water inlet port, and a water fill device mounted on said housing and usable for adding water to said reservoir through said water inlet port, said water fill device comprising:

a hollow, tubular water funnel having a front end located at the front end of said iron housing and a rear end opening to said water inlet port; said front end of said funnel forming an open mouth for receiving water poured into said funnel and said funnel having an inside surface adapted to funnel water from said mouth into said reservoir through an outlet port at said rear end thereof; and a shield within said water funnel in front of said outlet port, said shield having an outer margin spaced from said inside surface of said funnel, and a shield-supporting web connected to said inside surface of said funnel and to said shield.

6. The steam iron of claim 5 wherein said shield-supporting web comprises plural support posts extending longitudinally of said water funnel and connected to said shield.

7. The steam iron of claim 5 wherein said shield has an arcuate outwardly-facing surface, and said web and said mouth of said water fill device are constructed to enable a user to pour water into said water funnel around said shield without having water splash out of said water fill device.

* * * * *